US005761832A

United States Patent [19]

George

[11] Patent Number: 5,761,832

[45] Date of Patent: Jun. 9, 1998

[54] ATHLETIC SHOE HAVING RADIALLY EXTENDING RIBS

[76] Inventor: Gary F. George, 1589 Aline Dr., Grosse Pointe Woods, Mich. 48236

[21] Appl. No.: 634,294

[22] Filed: Apr. 18, 1996

[51] Int. Cl.[6] ..... A43B 23/28; A43B 13/00; A43B 13/04; A43C 15/00

[52] U.S. Cl. ..... 36/59 C; 36/103; 36/32 R

[58] Field of Search ..... 36/31, 59 C, 59 R, 36/32 R, 25 R, 114, 126, 127, 128, 129, 103; D2/947, 951, 954, 960

[56] References Cited

U.S. PATENT DOCUMENTS

| | | | |
|---|---|---|---|
| D. 298,483 | 11/1988 | Ligget et al. | D2/954 |
| D. 355,525 | 2/1995 | Minkin | D2/951 |
| 472,214 | 4/1892 | Hall | 36/103 X |
| 3,005,272 | 10/1961 | Shelare et al. | 36/29 |
| 3,719,965 | 3/1973 | Chevallereau | 12/146 B |
| 4,271,606 | 6/1981 | Rudy | 36/29 |
| 4,571,852 | 2/1986 | Lamarche et al. | D2/951 X |
| 4,593,482 | 6/1986 | Mayer | 36/7.5 |
| 4,670,997 | 6/1987 | Beekman | 36/114 |
| 4,676,010 | 6/1987 | Cheskin | 36/32 R |
| 4,897,936 | 2/1990 | Fuerst | 36/30 A |
| 5,203,097 | 4/1993 | Blair | 36/59 C |
| 5,313,718 | 5/1994 | McMahon et al. | 36/59 C |

FOREIGN PATENT DOCUMENTS

| | | | |
|---|---|---|---|
| 22515 | 5/1918 | France | 36/59 C |
| 962676 | 7/1964 | United Kingdom | 39/59 C |

*Primary Examiner*—B. Dayoan
*Attorney, Agent, or Firm*—Gifford, Krass, Groh, Sprinkle, Patmore, Anderson & Citkowski, P.C.

[57] ABSTRACT

An athletic shoe has an upper and a sole extending along the bottom of the upper. The sole has a ball portion along the front of the sole and a heel portion along the rear of the sole as well as a lower surface which lies in a substantially predetermined plane. A plurality of elongated recesses are provided in the sole so that the recesses extend radially outwardly from a preset point in the central part of the ball of the sole and so that the recesses are circumferentially spaced from each other. An elongated resilient member is positioned in each recess and each resilient member is dimensioned so that it is spaced inwardly from the sides of its associated recess and also so that the resilient member depends downwardly from the predetermined plane of the sole. In practice, when the person wearing the athletic sole pivots around the preset point in the ball of the sole, the resilient member collapses to one side of its associated recess depending upon the direction of the pivot.

13 Claims, 3 Drawing Sheets

ATHLETIC SHOE HAVING RADIALLY EXTENDING RIBS

BACKGROUND OF THE INVENTION

I. Field of the Invention

The present invention relates generally to athletic shoes and, more particularly, to court shoes.

II. Description of the Prior Art

There are a number of previously known athletic shoes which are particularly designed for court use. Such shoes, for example, are used on basketball courts, squash and racquetball courts, tennis courts and the like.

These previously known court shoes typically comprise an upper and a resilient sole extending across the bottom of the upper. The resilient sole, furthermore, includes a generally planar bottom which is adapted to contact and grip the court.

Typically a recessed pattern is molded or otherwise formed in the bottom of the sole. This recessed pattern has assumed a number of different configurations in the previously known court shoes. However, these previously known recessed patterns typically perform no function other than an ornamental one.

One disadvantage of these previously known court shoes, however, is that the athlete when pivoting from one side to the other typically pivots about the ball of the sole. In doing so, a relatively large area of sole is in contact with the court thus creating a relatively large amount of friction between the shoe and the court which must be overcome by the athlete. This force, which peaks at the initiation of the pivot, is typically transmitted to the knees of the athlete and, after prolonged periods of time, can result in damage to the athlete's knees and/or other joints.

SUMMARY OF THE INVENTION

The present invention provides an athletic shoe for court use which overcomes all of the above-mentioned disadvantages of the previously known court shoes.

In brief, the athletic shoe of the present invention comprises an upper and a sole extending across the bottom of the upper and having both a front and a rear. A ball portion of the sole is provided along the front of the sole and, similarly, a heel portion of the sole is provided along the rear of the sole. The sole itself is constructed of a resilient material and has a lower surface which lies in a predetermined plane.

A plurality of elongated recesses are provided in the bottom of the sole such that the recesses extend radially outwardly from a preset point in the central part of the ball of the sole corresponding to the pivot point for the athlete. Furthermore, these recesses are circumferentially spaced from each other.

An elongated resilient member is positioned in each recess. Each resilient member is dimensioned such that the resilient member is spaced inwardly from the sides of its associated recess and such that each resilient member depends downwardly from the predetermined plane of the sole.

In use, the weight of the athlete is supported by the resilient members which protrude downwardly from the bottom of the sole and thus provide a rather small area of contact between the shoe and the court. During a pivoting operation, however, the resilient members collapse to one side of the recess during the initial pivoting action which thus minimizes the pivoting force required by the athlete due to the small area of contact between the resilient members and the court as well as the collapsing action of the resilient members into their associated recesses.

After the initial pivoting action of the shoe and the resulting collapse of the resilient members to one side of their associated recesses, the resilient members become coplanar with the predetermined plane of the sole such that both the resilient members and the sole contact the court. In doing so, excellent traction is achieved between the shoe and the court at the end of the pivot.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
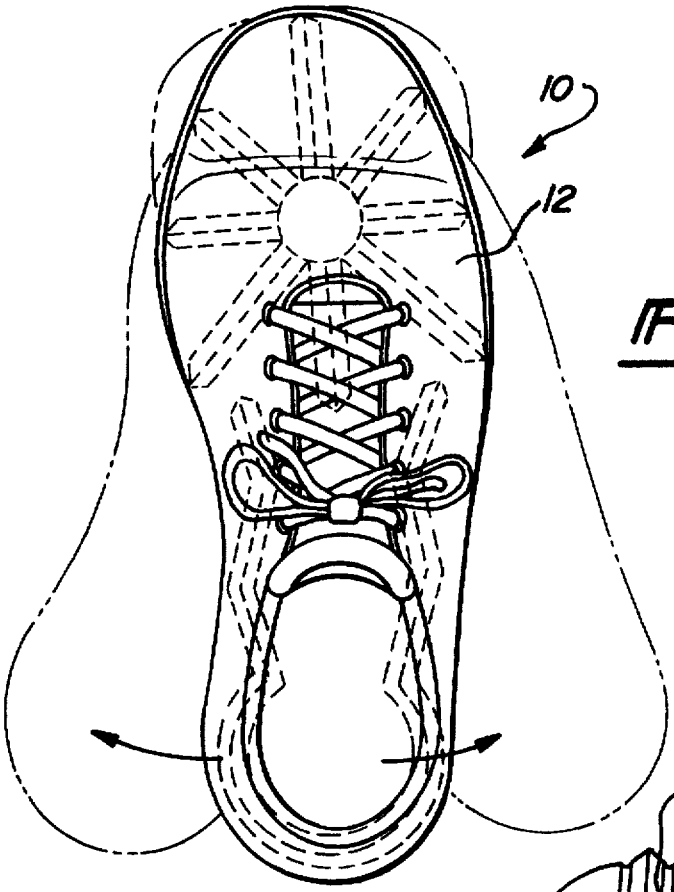
FIG. 1 is a top plan view illustrating a preferred embodiment of the athletic shoe of the present invention.
Figure 2:
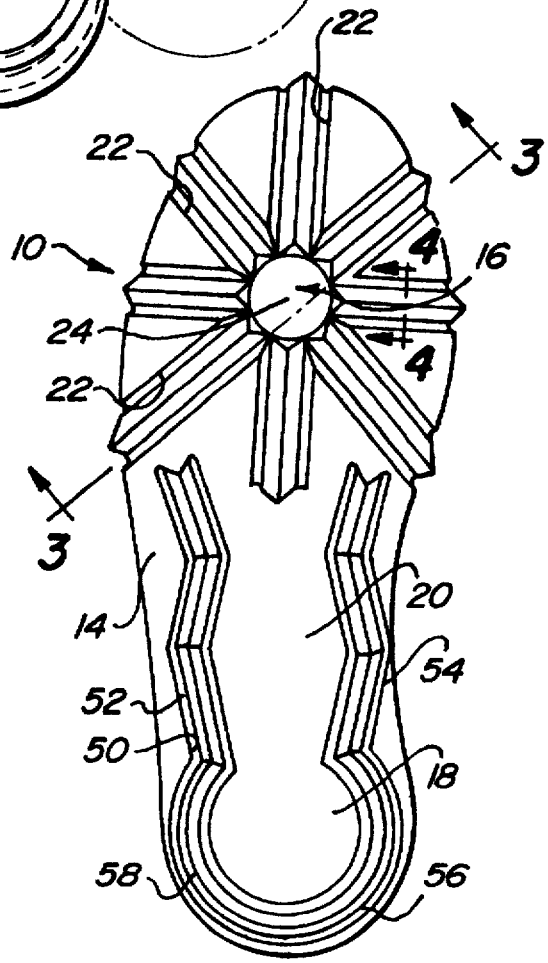
FIG. 2 is a bottom plan view illustrating the preferred embodiment of the athletic shoe of the present invention.

With reference first to FIGS. 1 and 2, a preferred embodiment of the athletic shoe 10 of the present invention is there shown and comprises an upper 12 (FIG. 1) and a sole 14 (FIG. 2) which extends along the bottom of the upper 12. The sole 14, furthermore, includes a ball portion 16 along its front and a heel portion 18 along its rear.

Figure 3:
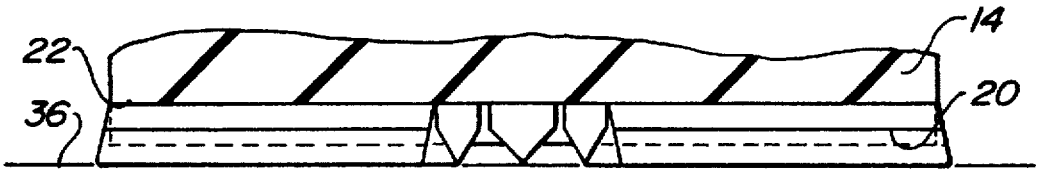
FIG. 3 is a longitudinal sectional view taken substantially along line 3—3 in FIG. 2.
Figure 4:
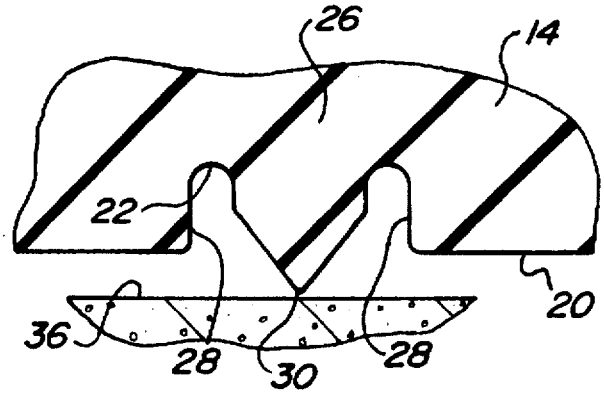
FIG. 4 is a sectional view taken substantially along line 4—4 in FIG. 3 and enlarged for clarity.

With reference now particularly to FIGS. 2–4, the sole 14 is constructed of a resilient material and includes a bottom surface 20 which lies in a predetermined plane. Preferably, the sole 14 is molded from a synthetic rubber.

A plurality of elongated recesses 22 are provided in the ball portion 16 of the sole 14 such that the recesses 22 extend radially outwardly from a preset point 24 (FIG. 2) in the ball portion 16 of the sole 14. Furthermore, these recesses 22 are preferably circumferentially spaced from each other while the point 24 corresponds to the pivot point of the sole 14.

As best shown in FIG. 4, an elongated resilient member 26 is disposed in each recess. Each resilient member 26, furthermore, is dimensioned so that it is spaced inwardly from the side 28 of its associated recess. Additionally, the elongated resilient member 26 is dimensioned so that a lower surface 30 of the resilient member 26 depends downwardly from the lower plane 20 of the sole 14.

As illustrated in the drawing, the resilient member 26 is generally V-shaped in cross-section. However, the resilient member 26 can assume any of a number of different shapes without deviation from the spirit or scope of the invention.

Figure 6:
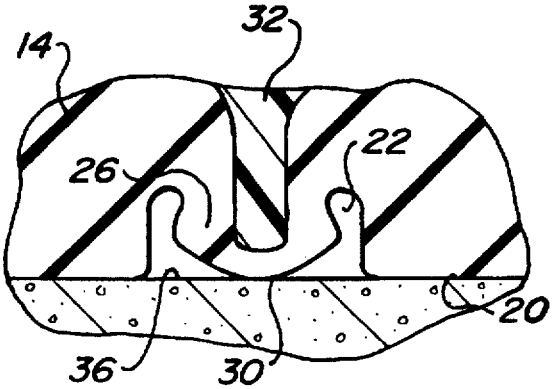
FIG. 6 is a view similar to FIG. 4 but illustrating the operation of the invention when the sole is subjected to increased downward force.
Figure 7:
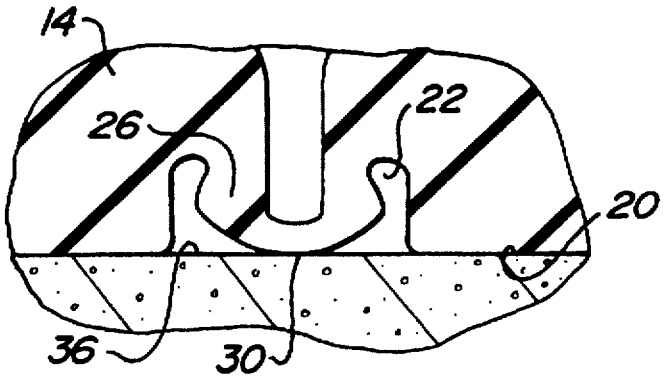
FIG. 7 is a view similar to FIG. 5, but illustrating a modification thereof.

With reference now to FIGS. 4 and 6, the resilient member 26 may be integrally molded with the sole 14 so that the resilient member 26 and sole 14 are of a one piece construction. Alternatively, as shown in FIG. 6, the resilient member 26 can include a core 32 of a different material and preferably of a different durometer. As shown in FIG. 7, the resilient member alternatively can be gas filled.

With reference again to FIGS. 2 and 4, the resilient members 26 are constructed of a material with sufficient stiffness so that, with the athlete standing on the court, the resilient members 26 depend downwardly from the bottom plane 20 of the sole 14 such that the athlete's weight is supported by the lower surface 30 of the resilient members 26. In doing so, a relatively small area of contact exists between the shoe 10 and the court 36.

Figure 5:
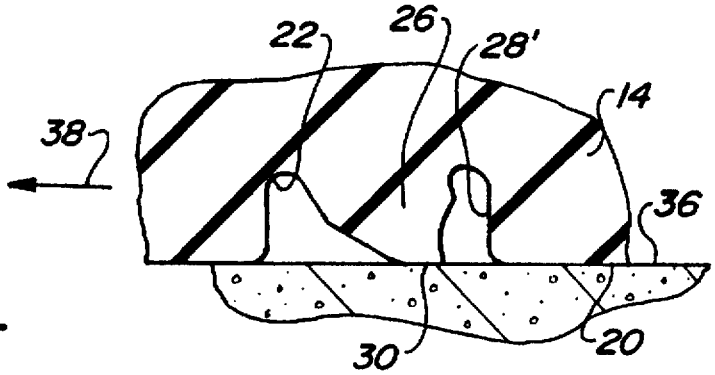
FIG. 5 is a view similar to FIG. 4 but illustrating the operation of the present invention.

With reference now to FIG. 5, during a pivoting operation in the direction of arrow 38, the shoe, while supported on the court 36 only by the resilient members 26 initially pivots from the position shown in phantom line and to the position shown in solid line. Furthermore, due to the relatively small area of contact between the resilient members 26 and the court 36, as well as the collapsing action of the resilient members 26, only minimal resistance to the pivoting action between the shoe and the court is encountered during the initial pivoting of the shoe 10.

When the shoe reaches the pivot position shown in solid line shown in FIG. 5, however, the resilient member 26 has collapsed to one side 28' of the recess 22 so that the bottom surface 30 of the resilient member 26 is coplanar with the predetermined bottom plane 20 of the sole 14. Since the remainder of the bottom of the sole 14 contacts the court at this time, enhanced traction is provided between the shoe and the court. Such enhanced traction is desirable at the end of the pivot.

Following completion of the pivoting operation, the resilient member is again returned to the position shown in FIG. 4 in which the bottom of the sole 14 is supported by the bottom surface 30 of the resilient members 26.

With reference now to FIG. 6, in some cases, such as a forward running action, the resilient members 26 are subjected to increased vertical force, but no pivoting force. In this case, the increased vertical force compresses the resilient member 26 into its associated recess 22 so that the bottom surface 30 of the resilient member 26 is coplanar with the bottom surface 20 of the sole 14. This provides increased contact between the shoe and the court and thus increased traction between the shoe and the court as desired.

With reference now to FIG. 2, at least one second elongated recess 50 is provided longitudinally along the heel 18 of the sole 14. As shown in FIG. 2, the recess 50 includes two longitudinally extending and laterally spaced sides 52 and 54 which are joined together by an arcuate section 56 along the rear of the sole 14. Other shapes, however, may alternatively be used without deviation from the spirit or scope of the invention.

An elongated second resilient member 58 is disposed within the recess 50. The relationship between the resilient member 58 and its recess 50 is the same as that between the resilient member 26 and its recess 22 (FIG. 4) so that a further description thereof will be unnecessary.

Referring again to FIG. 2, preferably, the elongated second recess 50 comprises a plurality of linear sections which intersect each other end to end at an obtuse angle. This obtuse angle provides increased resistance to lateral movement of the elongated second resilient member 58 which thus increases the side thrust traction between the sole 14 along the heel portion 18 and the court 36.

The elongated second resilient member 58 provides a number of advantages. One such advantage is that, in the event that the shoe is subjected to a side blow, the relatively small area of contact between the elongated second resilient member and the court allows the shoe to slide more easily which thus protects the player from injury. Conversely, when side thrust is required, the resilient member 58 collapses into its recess 50 in a manner similar to that shown in FIG. 5 and still achieves the increased traction between the heel portion 18 and the court when required.

From the foregoing, it can be seen that the present invention provides a novel athletic shoe particularly designed for court use. In particular, the resilient members 26 provide only a limited area of contact between the bottom of the shoe and the court prior to a pivoting action of the shoe. In a pivoting operation, the initial pivoting of the shoe is achieved with little resistance, and thus minimal stress to the player, due to the relatively small area of contact between the resilient members 26 and the court 36. However, once the initial pivoting has been completed, the resilient member 26 collapses to one side of its associated recess 22 such that the bottom of the sole 14 together with the resilient members 26 flatly engage the court for enhanced traction between the court and the shoe.

Having described my invention, however, many modifications thereto will become apparent to those skilled in the art to which it pertains without deviation from the spirit of the invention as defined by the scope of the appended claims.

I claim:

1. An athletic shoe comprising: an upper, a sole extending across a bottom of said upper and having a front and a rear, said sole having a ball portion along the front of said sole and a heel portion along said rear of said sole, said sole having a lower surface lying in a predetermined plane, said sole having a plurality of elongated recesses, said recesses each extending radially outwardly from a preset point in a central part of said ball of said sole so that said recesses are circumferentially spaced from each other, an elongated resilient member positioned in each recess, said resilient members being dimensioned such that each resilient member is spaced inwardly from the sides of its associated recess by a distance sufficient to enable said resilient member to collapse into its associated recess on either side of the resilient member so that said lower surface of said sole and a portion of said resilient member are coplanar, and each resilient member being dimensioned so that each resilient member depends downwardly from said predetermined plane, whereby pivoting of said sole about said preset point causes said members to collapse to one side of its associated recess such that said lower surface of said sole and said portion of said resilient member are coplanar to thereby increase the area of contact between the shoe and a supporting surface.

2. The athletic shoe as defined in claim 1 wherein said resilient members are V-shaped in cross section.

3. The athletic shoe as defined in claim 1 wherein said sole is constructed of a resilient material.

4. The athletic shoe as defined in claim 4 wherein said sole and said resilient members are of a one piece construction.

5. The invention as defined in claim 1 wherein with said resilient members collapsed to one side of their associated recess, a lower surface of said resilient member lies in said predetermined plane.

6. The athletic shoe as defined in claim 1 wherein said sole further includes a recess extending longitudinally along said heel portion and comprising at least one second resilient member positioned in said heel recess, said second resilient member being dimensioned such that said second resilient member is spaced inwardly from the sides of said heel recess and said second resilient member depends downwardly from said predetermined plane.

7. The athletic shoe as defined in claim 6 wherein said second recess extends along opposite sides of said heel portion.

8. The athletic shoe as defined in claim 7 wherein said second recess further comprises a plurality of end to end linear segments which intercept each other at an obtuse angle.

9. The athletic shoe as defined in claim 1 wherein at least one of said resilient members comprises a core and an outer layer, said core and said outer layer being constructed of a different material.

10. The athletic shoe as defined in claim 9 wherein said core and said outer layer have different durometers.

11. The athletic shoe as defined in claim 1 wherein said sole comprises a molded sole.

12. The athletic shoe as defined in claim 9 wherein said core is at least partially gas filled.

13. An athletic shoe comprising: an upper, a sole extending across a bottom of said upper and having a front and a rear, said sole having a ball portion along the front of said sole and a heel portion along said rear of said sole, said sole having a lower surface lying in a predetermined plane, said sole having a plurality of elongated recesses, said recesses each extending radially outwardly from a preset point in a central part of said ball of said sole so that said recesses are circumferentially spaced from each other, an elongated resilient member positioned in each recess, said resilient members being dimensioned such that each resilient member is spaced inwardly from the sides of its associated recess and each resilient member depends downwardly from said predetermined plane, whereby pivoting of said sole about said preset point causes said members to collapse to one side of its associated recess, wherein at least one of said resilient members comprises a core and an outer layer, said core and said outer layer being constructed of a different material, wherein said core is at least partially gas filled.

* * * * *